US009502829B2

(12) United States Patent
Chen

(10) Patent No.: US 9,502,829 B2
(45) Date of Patent: Nov. 22, 2016

(54) MODULAR JACK HAVING TRANSFORMER WITH WINDING WIRES AND METHOD OF MAKING THE SAME

(71) Applicant: HON HAI PRECISION INDUSTRY CO., LTD., New Taipei (TW)

(72) Inventor: Huan Chen, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 170 days.

(21) Appl. No.: 13/962,155

(22) Filed: Aug. 8, 2013

(65) Prior Publication Data

US 2014/0045380 A1 Feb. 13, 2014

(30) Foreign Application Priority Data

Aug. 8, 2012 (CN) ..... 2012 1 0280155

(51) Int. Cl.

| | |
|---|---|
| ***H01F 27/28*** | (2006.01) |
| ***H01F 5/00*** | (2006.01) |
| ***H01R 13/66*** | (2006.01) |
| ***H01R 24/64*** | (2011.01) |
| ***H01F 17/06*** | (2006.01) |
| ***H01F 19/00*** | (2006.01) |
| ***H01F 27/24*** | (2006.01) |
| ***H01F 27/30*** | (2006.01) |

(52) U.S. Cl.

CPC ..... *H01R 13/6633* (2013.01); *H01F 17/062* (2013.01); *H01F 19/00* (2013.01); *H01F 27/24* (2013.01); *H01F 27/2823* (2013.01); *H01F 27/306* (2013.01); *H01R 24/64* (2013.01)

(58) Field of Classification Search

CPC ..... H01F 5/00; H01F 27/28
USPC ..... 336/170, 200, 229, 232
See application file for complete search history.

(56) References Cited

U.S. PATENT DOCUMENTS

| | | | | |
|---|---|---|---|---|
| 5,280,648 | A | 1/1994 | Dobrovolny | |
| 2007/0040645 | A1* | 2/2007 | Sedio | H01F 19/06 336/232 |
| 2008/0197959 | A1* | 8/2008 | Buckmeier | H01F 17/06 336/107 |
| 2009/0186526 | A1* | 7/2009 | Xu | H01R 13/6658 439/620.22 |
| 2009/0253299 | A1* | 10/2009 | Zhang | H01R 13/65802 439/607.55 |
| 2010/0045420 | A1* | 2/2010 | Buckmeier | H01F 17/062 336/221 |

(Continued)

FOREIGN PATENT DOCUMENTS

| | | | |
|---|---|---|---|
| CN | 202282235 | U | 6/2012 |
| JP | 2005198146 | A | 7/2005 |

(Continued)

*Primary Examiner* — Tsz Chan
(74) *Attorney, Agent, or Firm* — Wei Te Chung; Ming Chieh Chang

(57) ABSTRACT

An electrical connector (500) includes a transformer (100) including a magnetic core (3), a first wire group (1), and a second wire group (2). The magnetic core has a left half (31), a right half (32), and an opening (30). The first and second wire groups each have four wires with different colors. Each wire has a first end, a second end, and a central portion. The central portion of the first wire group is only wound around the left half. The central portion of the second wire group is only wound around the right half.

4 Claims, 8 Drawing Sheets

(56) References Cited

U.S. PATENT DOCUMENTS

| | | | | |
|---|---|---|---|---|
| 2011/0053418 | A1* | 3/2011 | Margulis | H01R 13/719 439/620.07 |
| 2011/0167869 | A1* | 7/2011 | Geers | H01F 5/04 62/637 |
| 2012/0304462 | A1* | 12/2012 | Wei | H01F 41/0629 29/874 |
| 2012/0315794 | A1 | 12/2012 | Chen et al. | |
| 2012/0322309 | A1 | 12/2012 | Xu et al. | |

FOREIGN PATENT DOCUMENTS

| | | |
|---|---|---|
| TW | M341971 | 10/2008 |
| TW | M409577 | 8/2011 |
| WO | WO2010/045578 | 4/2010 |

* cited by examiner

MODULAR JACK HAVING TRANSFORMER WITH WINDING WIRES AND METHOD OF MAKING THE SAME

BACKGROUND OF THE INVENTION

1. Field of the Invention

The present invention relates to the field of electrical connectors suitable for use in data communication, more specifically to an electrical connector that include an inserting module and a method of making a transformer to be included in the inserting module.

2. Description of Related Art

U.S. Patent Application Publication No. 2012/0322309, published on Dec. 20, 2012, discloses a modular jack for 10 Gbps Ethernet that has a wrapping transformer. The transformer has eight wires (each preferably being formed from two individual wires) twisted together to form a group of wires wound around a toroidal core.

WO 2010/045578 published on Apr. 22, 2010 discloses a transformer for use in a magnetic jack and a method of manufacturing such a transformer.

U.S. Patent Application Publication No. 2012/0315794, published on Dec. 13, 2012, discloses a modular jack including a transformer and a choke for 10 Gbps Ethernet application. To produce such a transformer, a first and third conductive wires are twisted together separately from a second and fourth conductive wires when they are wound through a toroidal core. Such a configuration provides a benefit in that the capacitive coupling between the first and third conductive wire is less affected by any unintentional capacitive coupling between the first and third conductive coupling between the first conductive wire and either the second or fourth conductive wire. Also disclosed are the dual-wire feature and a common-mode sensing circuit that provides feedback regarding the common mode energy that passes through the choke.

An electrical connector having an improved electrical performance is desired.

SUMMARY OF THE INVENTION

The present invention provide an electrical connector including a transformer. The transformer includes a magnetic core, a first wire group, and a second wire group. The magnetic core has a first and second faces, and a central opening extending perpendicular to the first and second faces. Each of the first and second wire groups includes four wires each having a central portion, a first end and an opposite second end, and the central portions being twisted together and wound around the magnetic core in one direction through the central opening. The magnetic core includes a left half and a right half. The central portion of first wire group is only wound around the left half. The central portion of second wire group is only wound around the right half.

Other objects, advantages and novel features of the invention will become more apparent from the following detailed description when taken in conjunction with the accompanying drawings.

DETAILED DESCRIPTION OF THE PREFERRED EMBODIMENT

Figure 1:
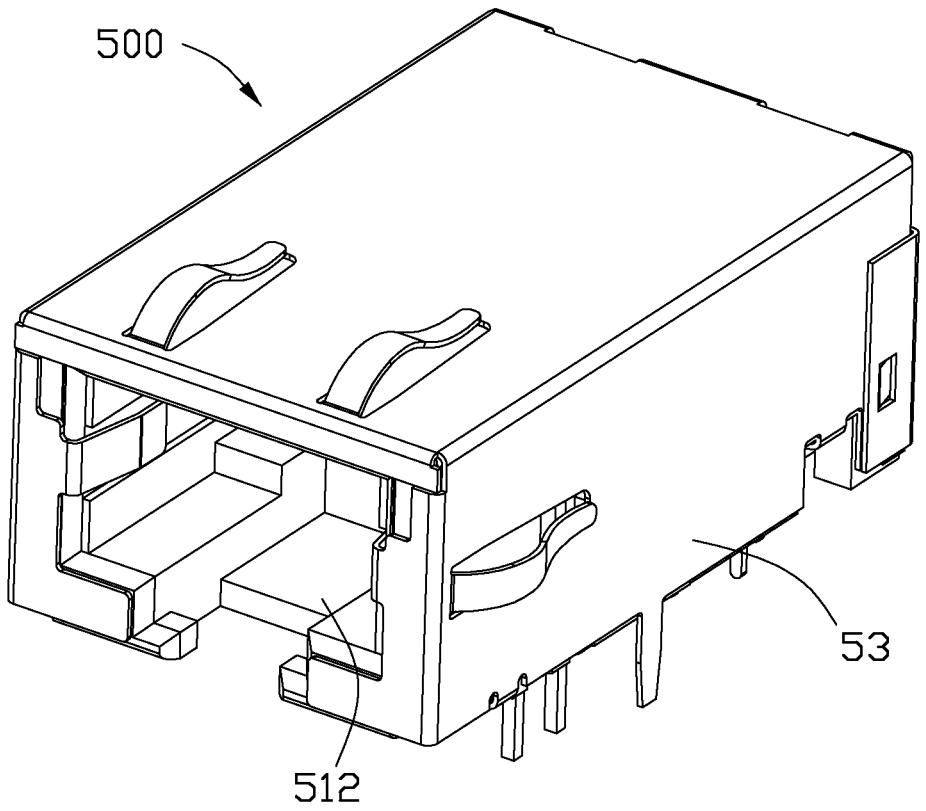
FIG. 1 illustrates a perspective view of an embodiment of an electrical connector.

Reference will now be made in detail to the preferred embodiment of the present invention.

Referring to FIGS. 1-4, an electrical connector (modular jack) 500 according to the present invention is shown. The electrical connector 500 can be mounted on a supporting circuit board (not shown). The electrical connector 500 has an insulative housing 51, two light emitting diodes (LEDs) 52 respectively installed on two sidewalls 511 of the housing 51, an inserting module 50 installed into the insulative housing 51 along a back-to-front direction, and a shielding shell 53 surrounding the insulative housing 51. The insulative housing 51 includes a port 512 configured to receive a plug connector (RJ45) with a high speed, e.g., 10 Gigabit/second. The inserting module 50 includes a plurality of terminals 501 positioned in the port 512, a plurality of pins 502 for mounting onto the supporting circuit board, and a printed circuit board assembly (PCBA) 503 electrically connecting the terminals 501 to the pins 502. The PCBA 503 includes a PCB 5 disposed horizontally, a plurality of transformers 100 mounted on an upper face 54 of the PCB 5, a plurality of common mode chokes (CMCs) 6 mounted on a lower face 55 of the PCB 5, and a plurality of capacitors 7 and resistors 8 mounted on the PCB 5. The PCB 5 has two rows of conductive pads 56 disposed on the upper face 54 and a plurality of conductive pads 56 disposed on the lower face 55. The wire ends (not shown) of transformers are soldered to the conductive pads 56, respectively. The CMC 6 has a plurality of soldering pads surface mounted to the conductive pads 56 of lower face 55. The transformer 100 is coupled to the CMC 6 via conductive paths of the PCB 5.

Figure 4:
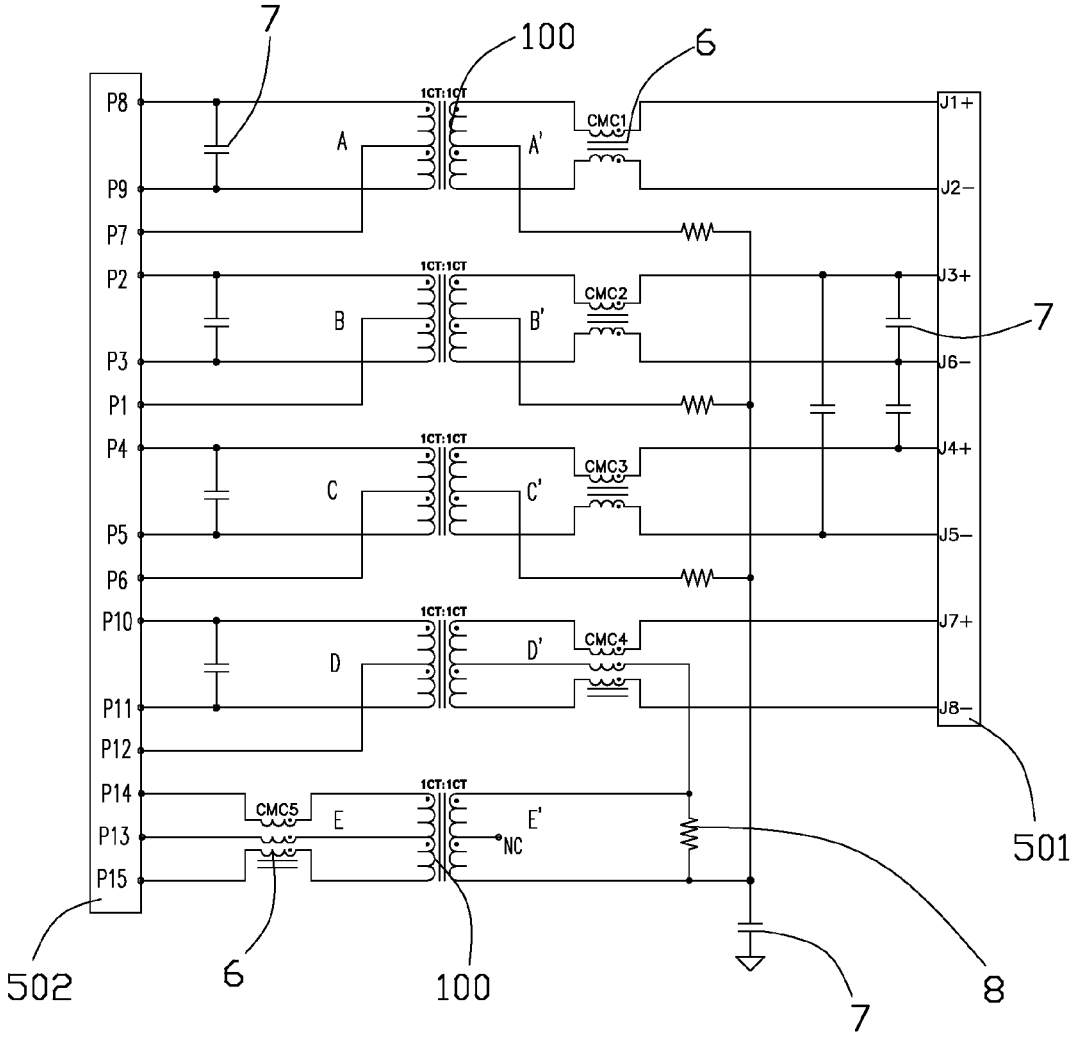
FIG. 4 illustrates a schematic of the electrical connector shown in FIG. 2.

Referring to FIG. 4, the electrical connector 500 includes five transformers 100 and five CMCs 6; one centre tap NC of one transformer 100 is not electrically connected to the capacitor 7, and this transformer is used for detecting channel.

Figure 5:
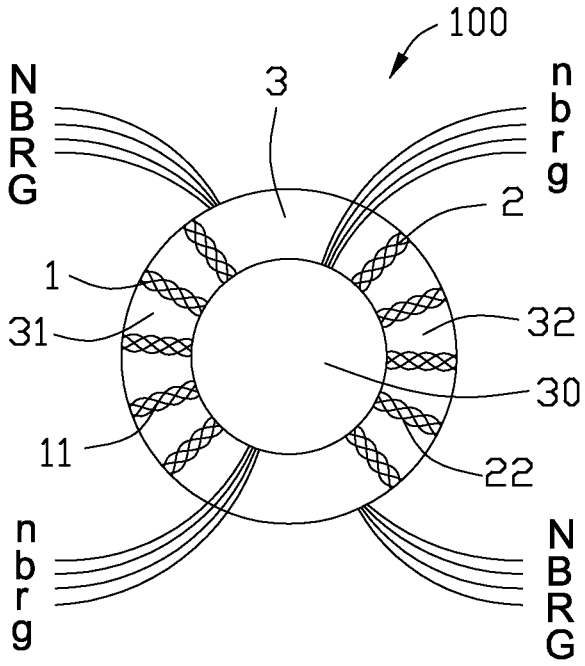
FIG. 5 illustrates a top view of an embodiment of a transformer without twisting ends of wires.
Figure 6:
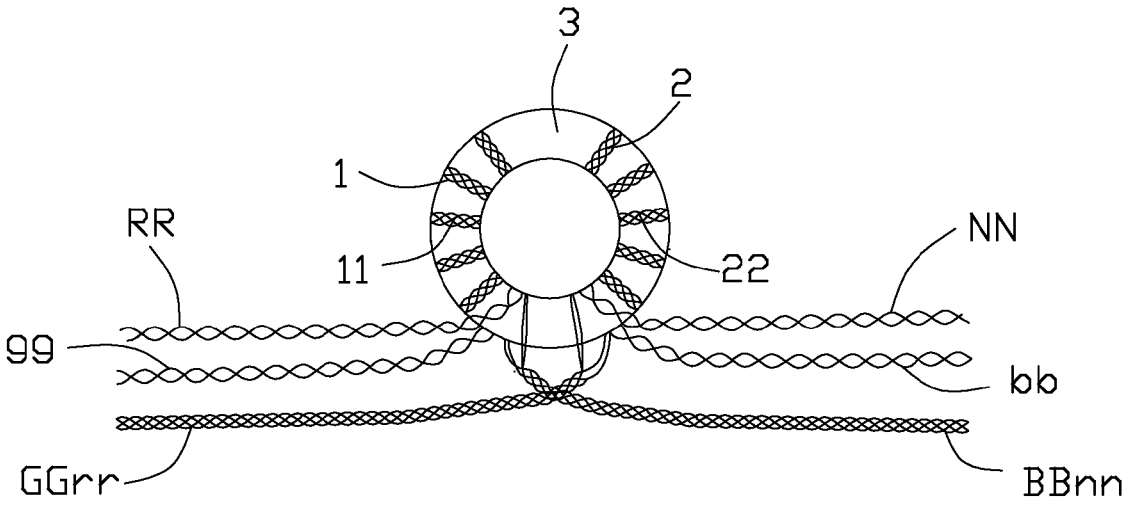
FIG. 6 illustrates the transformer with twisting ends of wires together shown in FIG. 5.
Figure 7:
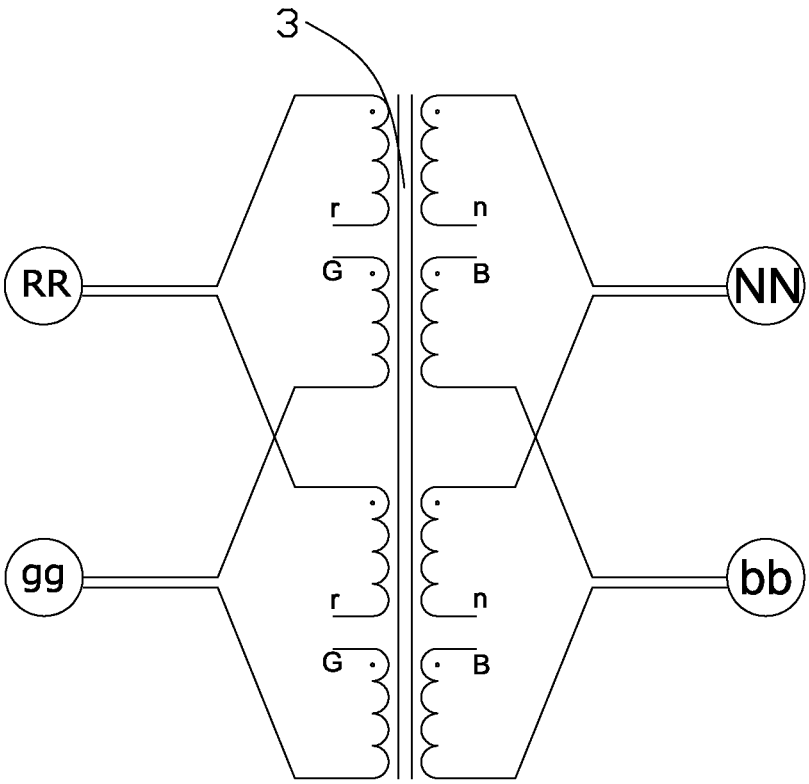
FIG. 7 illustrates a schematic of the transformer shown in FIG. 6.

Referring to FIGS. 5-7, the transformer 100 includes a magnetic core 3, a first wire group 1, and a second wire group 2. The magnetic core 3 has a first and second faces, and a central opening 30 extending perpendicular to the first and second faces. Each of the first and second wire groups 1, 2 is formed of four wires with different colors (Natural, Blue, Red, Green). The first wire group 1 includes four wires each having a central portion 11, a first end (NBRG), and an opposite second end (nbrg), and the central portions 11 are twisted together and wound around the magnetic core 3 in one direction through the central opening 30. The second wire group 2 includes four wires each having a central portion 22, a first end (NBRG), and an opposite second end (nbrg), and the central portions 22 are twisted together and wound around the magnetic core 3 in one direction through the central opening 30. The magnetic core 3 includes a left half 31 and a right half 32. The central portion 11 of first wire group 1 is only wound around the left half 31. The central portion 22 of second wire group 2 is only wound around the right half 32. The first wire group 1 and the second wire group 2 are wound along a same direction along the magnetic core 3.

Referring to FIG. 5, the first end (NBRG) of the first wire group 1 and the second end (nbrg) of the second wire group 2 are pulled from top-to-bottom (in the sense of viewing at the drawing sheet) for twisting with the second end (nbrg) of the first wire group 1 and the first end (NBRG) of the second wire group 2 to form input ends (NN, bb), output ends (RR, gg), and centre taps (GGrr, BBnn) (FIG. 6).

Referring to FIGS. 6-7, the first and second wire groups 1, 2 joint to function as a primary winding and a secondary winding of the transformer (FIG. 7). The wire ends (NBRG, nbrg) of the first wire group 1 and the wire ends (NBRG, nbrg) of the second wire group 2 are twisted to form input ends (NN, bb), output ends (RR, gg), and centre taps (GGrr, BBnn) of the transformer 100 (FIGS. 6-7).

Figure 8:
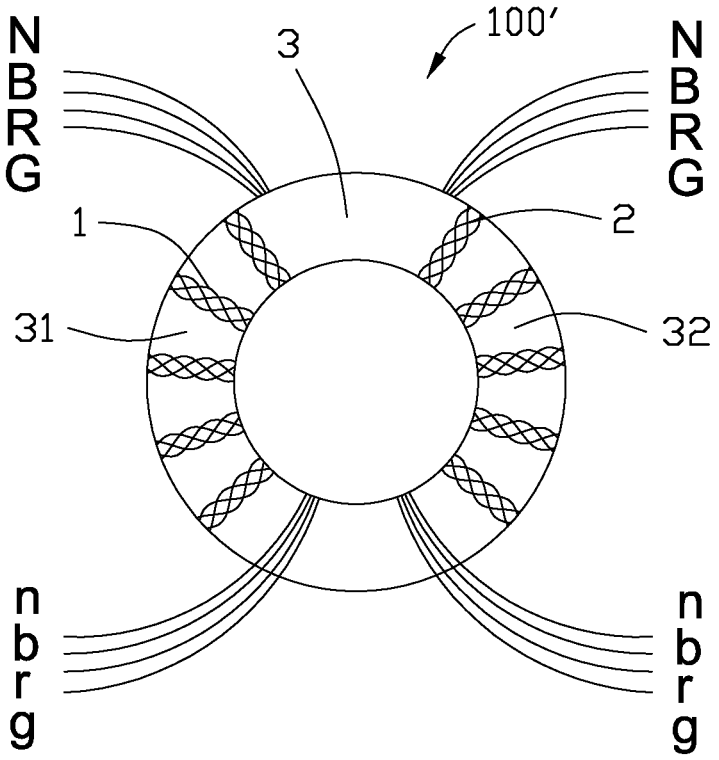
FIG. 8 is a top view of another embodiment of a transformer without twisting ends of wires.

Referring to FIG. 8, the transformer 100' according to another embodiment of the invention is different from the transformer 100 only in that the first wire group 1 and the second wire group 2 are wound along two opposite directions along the magnetic core 3. The wires of transformer 100' should be wound two times for forming the first and second wire groups 1, 2. The wires of transformer 100 could be only wound one time for forming the first and second wire groups 1, 2.

Figure 2:
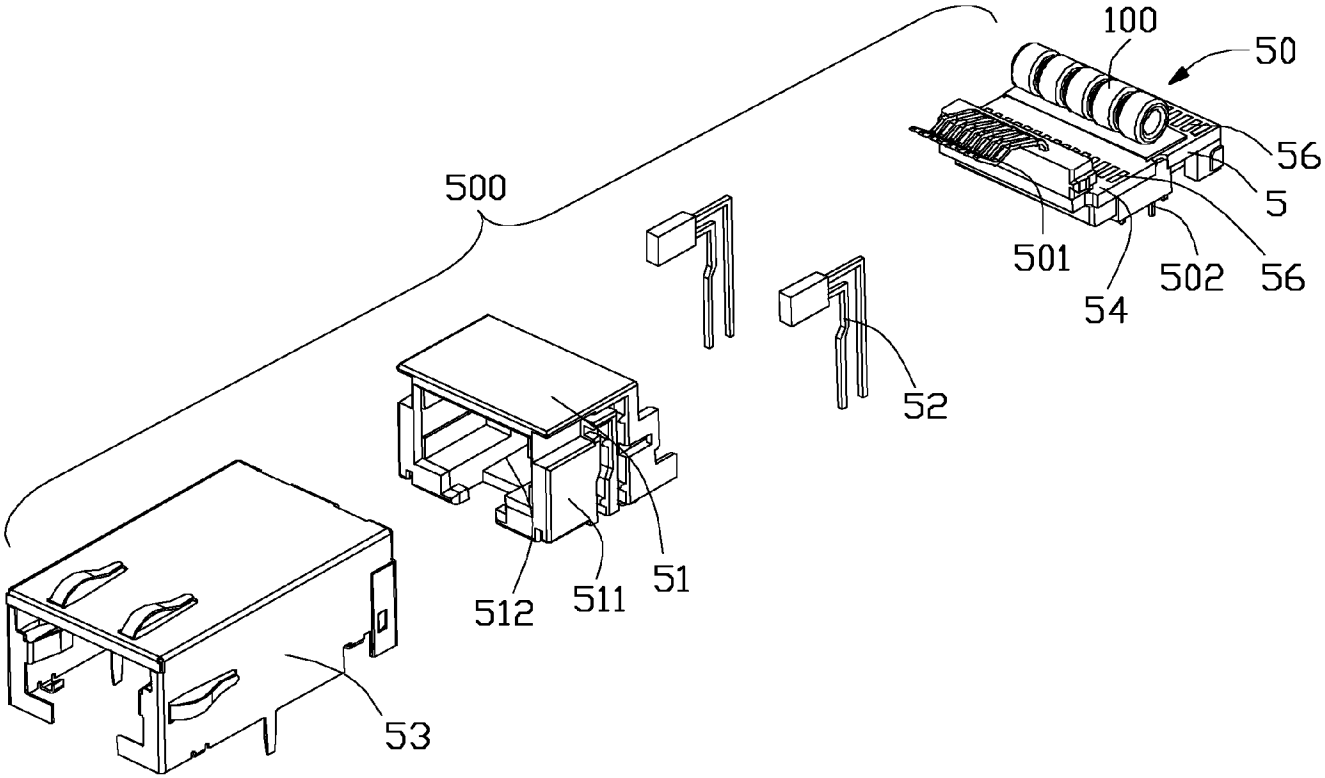
FIG. 2 illustrates an exploded view of the electrical connector, with wires of transformers removed therefrom.
Figure 3:
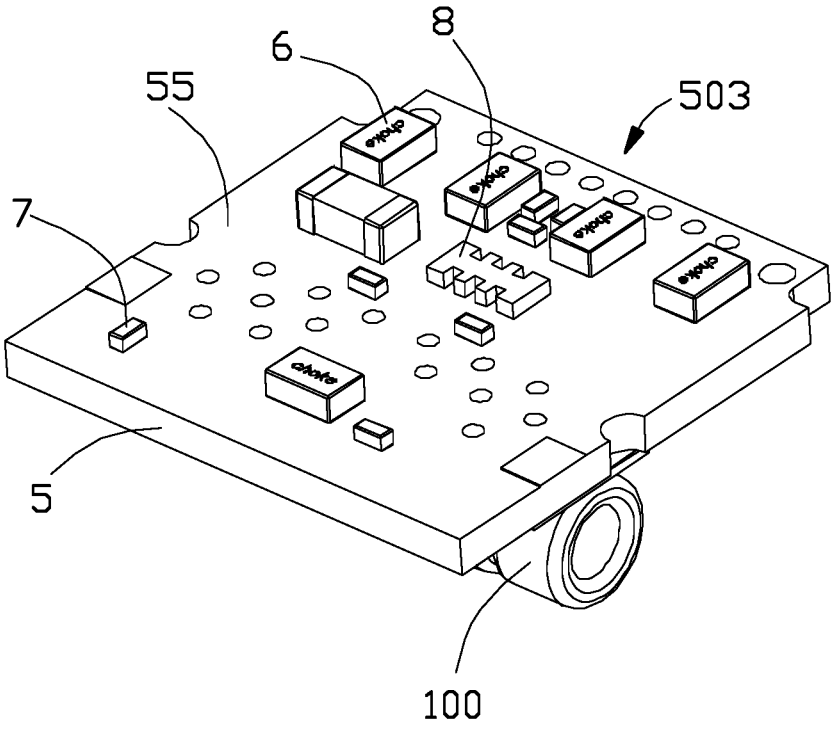
FIG. 3 illustrates a perspective view of a printed circuit board assembly shown in FIG. 2.

A method for making the transformer 100 comprises the steps of:

(1) providing four wires with different colors (Natural, Blue, Red, Green);

(2) twisting the four wires to form a bundle of wires having a first end (NBRG) and an opposite second end (nbrg);

(3) providing a magnetic core 3 having a first face, a second face, and a central opening 30 extending perpendicular to the first and second faces, the magnetic core 3 including a left half 31 and a right half 32;

(4) winding the bundle of wires around the magnetic core 3 in one direction with the first end (NBRG) extending out from the central opening 30 through the first face of the magnetic core 3 and the second end (nbrg) extending out from the central opening 30 through the second face of the magnetic core 3;

(5) cutting the bundle of wires from the intermediate point thereof to form a first and a second groups of wires 1, 2, and pulling the first end (NBRG) of the first wire group 1 and the second end (nbrg) of second wire group 2 from top-to-bottom for close to the second end (nbrg) of the first wire group 1 and the first end (NBRG) of second wire group 2, the central portion 11 of the first group of wires 1 only wound around the left half 31, the central portion 22 of second group of wires 2 only wound around the right half 32;

(6) untwisting the ends of the two groups of wires to form individual ends (similar to FIG. 5);

(7) twisting corresponding individual ends to form input ends (NN, bb), output ends (RR, gg), and centre taps (GGrr, BBnn) of a primary winding and a secondary winding of a transformer 100 (FIG. 6), each input end consisting of paired wires with same color, each output end consisting of paired wires with same color, and each centre tap consisting of two paired wires with two different colors;

(8) providing a printed circuit board (PCB) 5 having two rows of conductive pads 511, placing the magnetic core 3 of the transformer 100 onto the PCB 5 and between the two rows of conductive pads 511, and soldering the input ends (NN, bb), output ends (RR, gg), and centre taps (GGrr, BBnn) to respective conductive pads 512; and (9) providing a common mode choke (CMC) 6 having a plurality of soldering pads, and soldering the soldering pads to the PCB 5 to thereby couple the CMC 6 to the transformer through the PCB 5. After these steps, assemble other parts to form the electrical connector 500 (FIGS. 1-2).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed. It could be noted that in the alternate embodiment, the two wires may replace the four wires of the disclosed embodiment because the four wires performs essentially the so-called Litz effect superior to the two wires arrangement.

What is claimed is:

1. A transformer comprising:

a magnetic core having a first and second faces, and a central opening extending perpendicular to the first and second faces;

a first and second wire groups each including four wires, each wire having a central portion, a first end, and an opposite second end, the central portions being twisted together and wound around the magnetic core in one direction through the central opening; wherein the magnetic core includes a first half and a second half, the central portion of the first wire group only wound around the first half, the central portion of the second wire group only wound around the second half;

wherein said first and second wire groups joint to function as a primary winding and a secondary winding, and said first and second ends of the first and second wire groups are respectively twisted as input ends, output ends, and center taps of the primary and secondary windings;

wherein said primary winding includes two input ends and a first center tap, each of the two input ends having one wire end coining from the first wire group and one wire end coining from the second wire group, the first center tap having two wire ends coining from the first wire group and two wire ends coining from the second wire group;

wherein said secondary winding includes two output ends and a second center tap, each of the two output ends having one wire end coining from the first wire group and one wire end coining from the second wire group, the second center tap having two wire ends coining from the first wire group and two wire ends coining from the second wire group.

2. The transformer as claimed in claim 1, wherein the input ends and the first center tap are disposed at a first side of the magnetic core, and the out ends and the second center tap are disposed at a second side opposite to the first side of the magnetic core.

3. The transformer as claimed in claim 2, wherein the first center tap intercrosses with the second center tap.

4. The transformer as claimed in claim 1, wherein the first and second wire groups are formed by cutting an intermediate point of a bundle of wires.

* * * * *